United States Patent [19]

Peck et al.

[11] 4,357,843

[45] Nov. 9, 1982

[54] TONG APPARATUS FOR THREADEDLY CONNECTING AND DISCONNECTING ELONGATED MEMBERS

[75] Inventors: Marvin H. Peck; Larry M. DeSmit; John D. Conlon, all of Houston, Tex.; Frank O. Bynum, Stonewall, Okla.

[73] Assignee: Peck-O-Matic, Inc., Houston, Tex.

[21] Appl. No.: 202,596

[22] Filed: Oct. 31, 1980

[51] Int. Cl.[3] ..... B25B 17/00

[52] U.S. Cl. ..... 81/57.16; 81/57.18; 81/57.2

[58] Field of Search ..... 81/57.18, 57.2, 57.16

[56] References Cited

U.S. PATENT DOCUMENTS

| | | | |
|---|---|---|---|
| 2,556,536 | 6/1951 | Harris | 81/57.18 |
| 2,989,880 | 6/1961 | Hesser et al. | 81/57.18 |
| 3,141,362 | 7/1964 | Tammy et al. | 81/57.18 |
| 3,180,186 | 4/1965 | Catland | 81/57.18 |
| 4,084,453 | 4/1978 | Eckel | 81/57.18 |
| 4,291,598 | 9/1981 | Cherry | 81/57.18 |

*Primary Examiner*—James L. Jones, Jr.
*Attorney, Agent, or Firm*—Jack W. Hayden

[57] ABSTRACT

A tong apparatus for threadedly connecting and disconnecting elongated members is provided with a housing having a slot for receiving members to be connected. A cage support is rotatably carried by the tong housing and includes a slot for aligning with the tong housing slot to receive the members. Cage apparatus are provided in the cage support and include a slot for aligning with the tong housing slot and cage support slot to receive the members with jaws pivotally supported by the cage and having gripping surface apparatus to grip one of the members. Apparatus are provided to rotate the cage support with apparatus to initially restrain relative rotation between the cage and the cage support upon rotation of the cage support, with the cage support and jaw including cooperating apparatus engageable upon rotation of the cage support to urge the jaws into gripping engagement with one of the members. The jaws are constructed and arranged in one embodiment to fit various sizes of elongated tubular members without any adjustment to the tong apparatus. Backup apparatus carried by the housing engage with the other member and hold it while the cage support, cage and jaws and rotated to rotate the other member to threadedly connect or disconnect the elongated members as desired.

1 Claim, 9 Drawing Figures

TONG APPARATUS FOR THREADEDLY CONNECTING AND DISCONNECTING ELONGATED MEMBERS

SUMMARY OF THE INVENTION

Various types of tong arrangements have been heretofore provided and are presently in use for threadedly connecting and disconnecting elongated members together, such as tubular members, or sucker rods normally employed in oil and gas well operations.

Generally such arrangements include a housing, gear means and power means associated therewith, whereby rotation may be imparted to a jaw means supported by the housing in any suitable manner to effect engagement of the jaw means with the elongated members and thereafter to rotate one of the elongated members relative to the other to either threadedly connect or disconnect the elongated members together.

However, so far as known to applicant, no tong apparatus has heretofore provided a construction to enable elongated tubular members, particularly such as sucker rods, to be connected and disconnected, which tong apparatus is constructed and arranged to accomodate various size sucker rods without any adjustment to the jaw means or tong apparatus.

Also, the means heretofore employed to initially restrain the jaws and effect movement thereof so as to grip the elongated tubular members have been positioned relative to the housing so as to be more likely to collect debris and become fouled or inoperative. This necessitates removal of the tong from use and cleaning or service to make it operative.

The present invention overcomes this in that it positions the means to restrain the jaw means above the jaw means to overcome such problem.

Also, in tong arrangements known to applicant as heretofore employed, the restraining means which includes a brake band and a drag shoe has normally been constructed and arranged so that when such restraining means is removed from the tong apparatus, it readily separates, thus requiring additional time to reassemble before the tong can be put into operation.

The present invention overcomes this in that the brake band and drag shoe are constructed and arranged so that the brake band is secured to a housing, and the drag shoe in turn is carried on the brake band, thus retaining the brake band and drag shoe in proper relationship even though such restraining means may be removed from its position on the tong apparatus.

Other objects and advantages of the present invention will become more apparent from a consideration of the following description and drawings.

DESCRIPTION OF THE PREFERRED EMBODIMENTS

Figure 1:
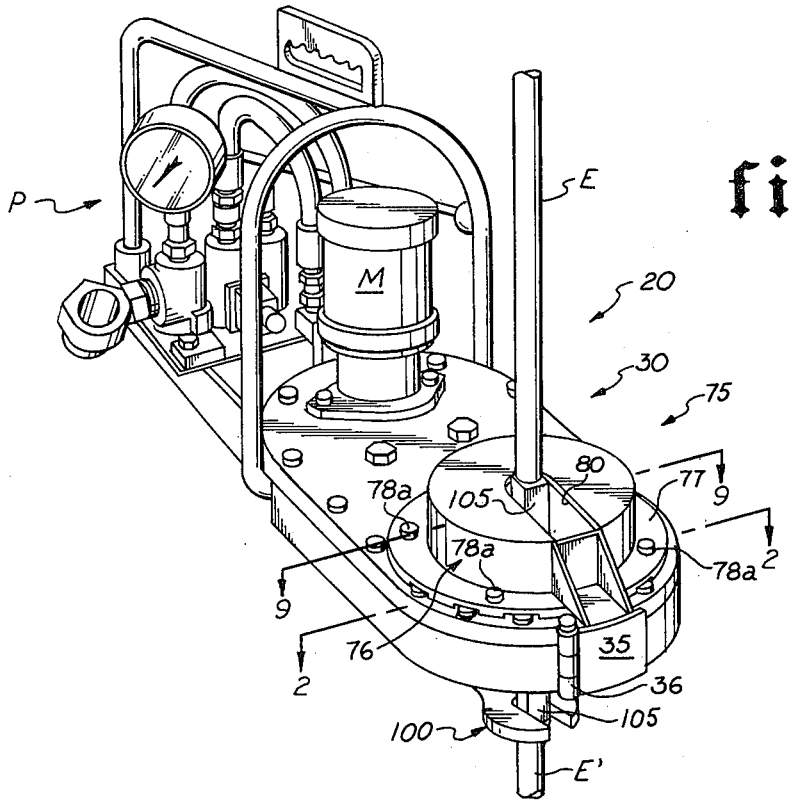
FIG. 1 is a perspective view showing the tong apparatus of the present invention in assembled relationship and engaged with elongated members.

Attention is first directed to FIG. 1 of the drawings wherein the tong apparatus of the present invention is referred to generally by the numeral 20. A housing referred to generally at 30 is provided with suitable power source means as referred to by the letter P which may be either pneumatic, electric or hydraulic for supplying power to the motor M illustrated as being mounted on the housing 30. For purposes of illustration and description only, and not by way of limitation, the power source P and motor M will be described as hydraulic, however, as noted previously, any suitable power arrangement may be employed.

A pair of elongated members E and E′ are illustrated as being positioned within the tong apparatus 20 of the present invention for threadedly connecting or disconnecting such elongated members as may be desired.

Figure 2:
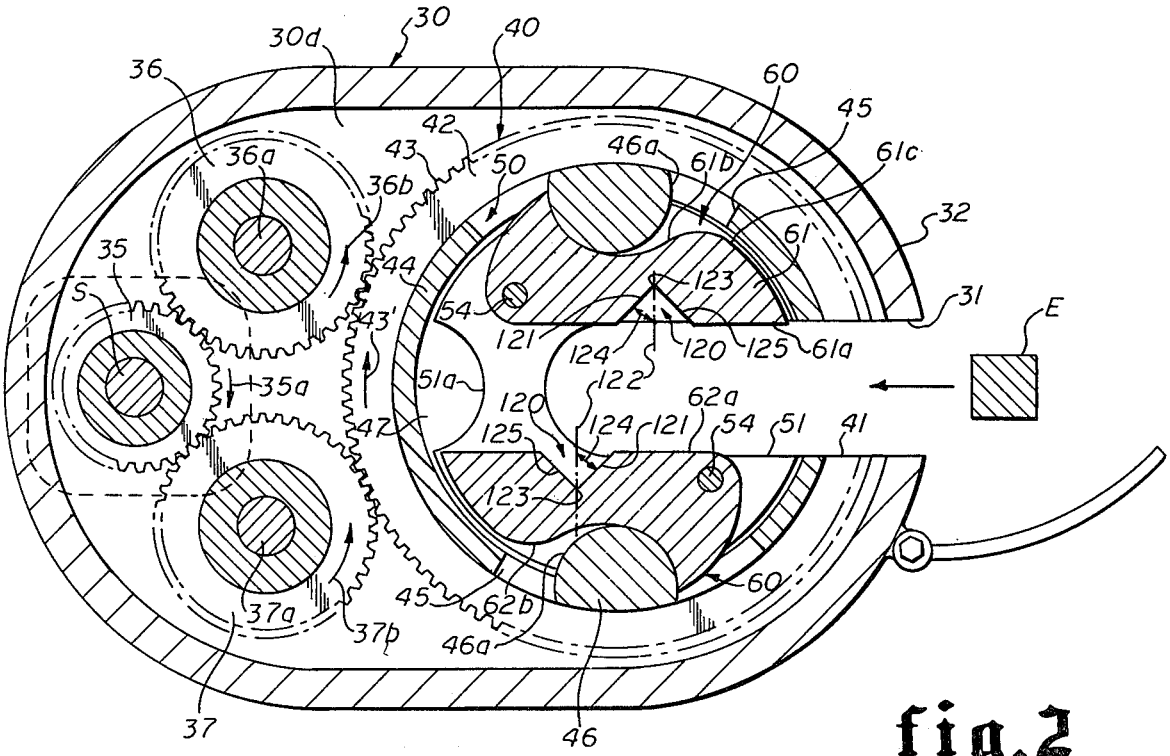
FIG. 2 is a sectional view on the line 2—2 of FIG. 1 illustrating in greater detail the relationship of the housing means, the cage support means with the cage therein, the slot means in the housing means, cage support means and cage aligned for receiving an elongated member therein, and the gear means arrangement for imparting rotation to the cage support means to actuate the jaw means in the cage means to engage them with one of the members to be threadedly connected or disconnected and to thereafter effect rotation of such member.

In FIG. 2 the shaft S of the motor M is shown as having connected to the lower end thereof a pinion 35 which meshes with the gears 36 and 37 supported on shafts 36*a* and 37*a*, respectively, for imparting rotation to the final drive gear means referred to generally at 40 which final drive gear means also forms a cage support means to receive the cage means referred to generally at 50 in FIGS. 5 and 7, as will be described in greater detail hereinafter. The shafts 36*a* and 37*a* are mounted on the bottom 30*d* of the housing 30.

The cage support or final drive gear means 40 is maintained in rotatable position in the tong housing 30 by any suitable bearing means well known to those skilled in the art, therefore, such detail is not believed necessary to an understanding of the present invention.

It will be further noted that the tong housing 30 is provided with a slot 31 extending longitudinally from one end 32 of such housing, with which the slot means 41 in the cage support means 40 may be aligned along with the slot means 51 formed in the cage means 50 to enable the elongated members E and E′ to be positioned in the tong apparatus 20 as shown in FIG. 1 of the drawings.

Figure 5:
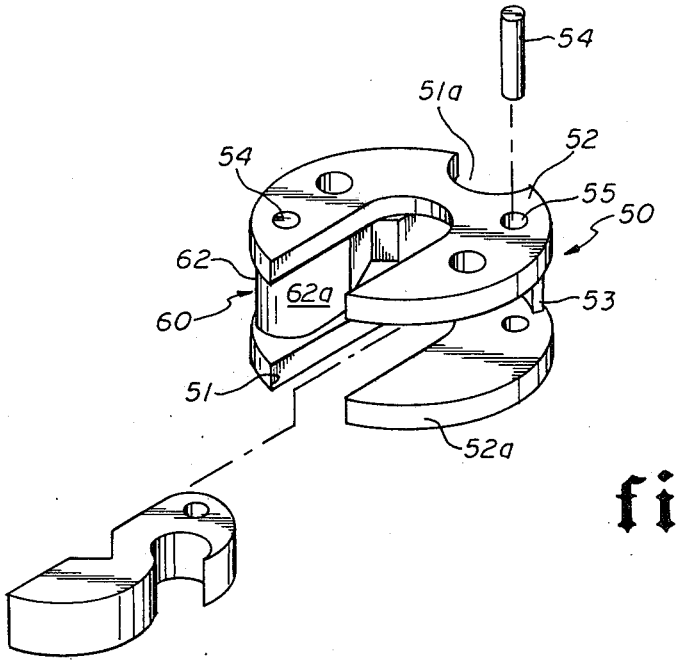
FIG. 5 is a perspective view, partially exploded, of the cage means illustrating the details of construction and the arrangement of the jaw means in the cage assembly or means.

The cage support means 40 may be described as including the annular ring member 42 which is provided with the gear teeth 43 for engaging with gear means 36 and 37 as better shown in FIGS. 2 and 5. An annular wall 44 is secured to and extends upwardly from the ring 42 as shown in the drawings. The wall 44 is spaced radially inwardly of the gear teeth or circumferential edge of ring member 42. The annular wall 44 is provided with a plurality of spaced, circumferentially extending apertures or slots 45 to enable the jaw means referred to generally at 60 which are carried by the cage means 50 to fully retract from the slot means 51 of the cage means 50, the slot means 41 of the cage support means and the slot means 31 of the housing 30, as illustrated in FIG. 2 of the drawings.

The annular, vertically extending wall 44 of the cage support means 40 provides an annular receptacle to receive the cage means 50, which cage means rests on the surface 47 forming the bottom of the receptacle. The slot means 41 is formed in the bottom 47 as better seen in FIG. 7 of the drawings. It will also be noted that the annular upward extending wall 44 projects through an opening 33 in the top 34 of the tong housing 30 as better seen in FIG. 7 of the drawings.

The cage support means 40 also includes a pair of cams 46 which are in diametrically opposed relationship, are mounted on, and project inwardly from annular wall 44 into the receptacle as shown in the drawings to engage the jaws 60 and effect movement to engage with the elongated member E and disengage therefrom as will be described in greater detail hereinafter.

Figure 7:
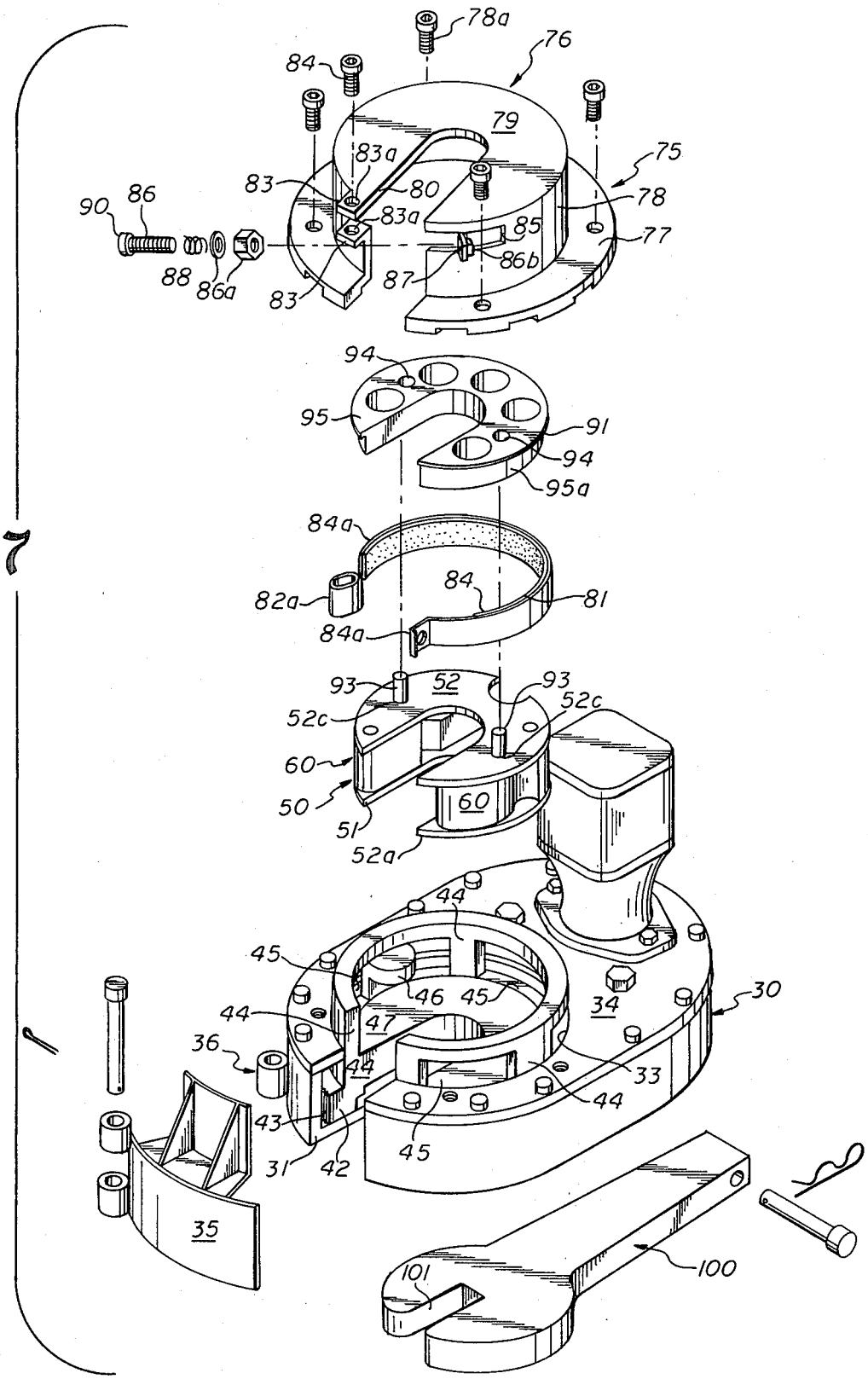
FIG. 7 is an exploded view illustrating, beginning at the top of such view and continuing down the page, then the drag band or restraining means housing, then the drag shoe, brake band, cage means, cage support means supported by the housing means and the backup means carried by the housing for holding one of the members while the other member is rotated to effect connection or disconnection between such members.

The cage means or cage assembly 50 which carries the jaw means 60 is shown in greater detail in FIGS. 5 and 7 and is there illustrated as comprising two spaced plates 52 and 52*a* which are maintained in spaced relation by any suitable means such as the vertically extending brace 53 extending therebetween. The jaw means 60 are pivotally connected to the plates 52 and 52*a* by the pins 54 which extend through their respective openings 55 formed in each plate 52, 52*a* and through openings 56 in the jaw means 60.

Figure 3:
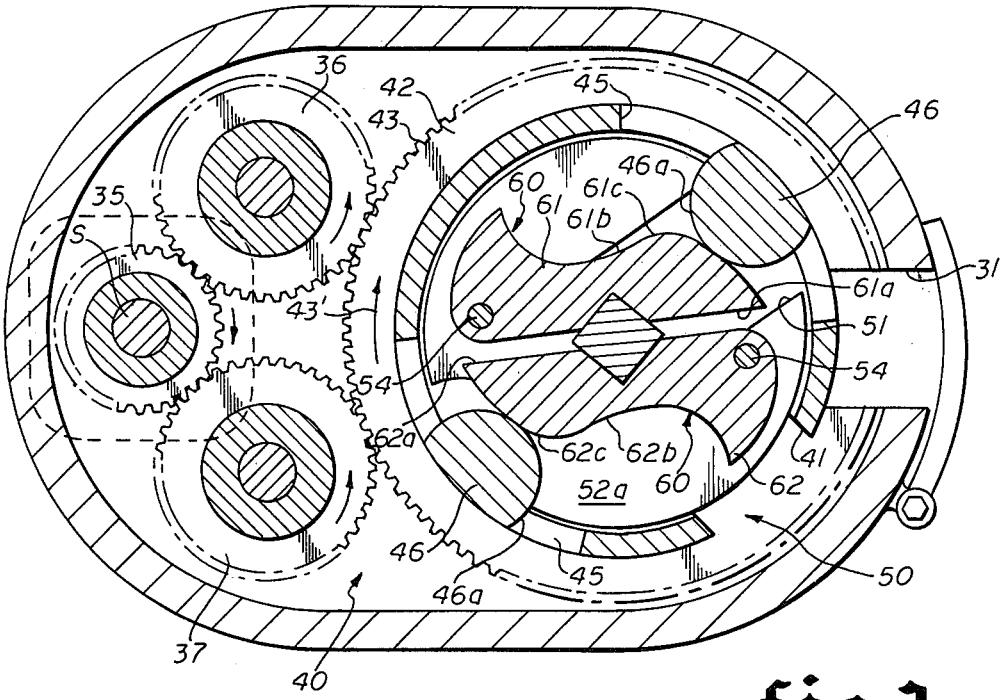
FIG. 3 is a sectional view similar to FIG. 2 but illustrates the relationship of the jaw means, cage means, and cage support means as well as the cams on the cage support means when rotated, or activated to urge the jaw means into operative engagement with the elongated member for rotation thereof along with the cage support means and cage.
Figure 4:
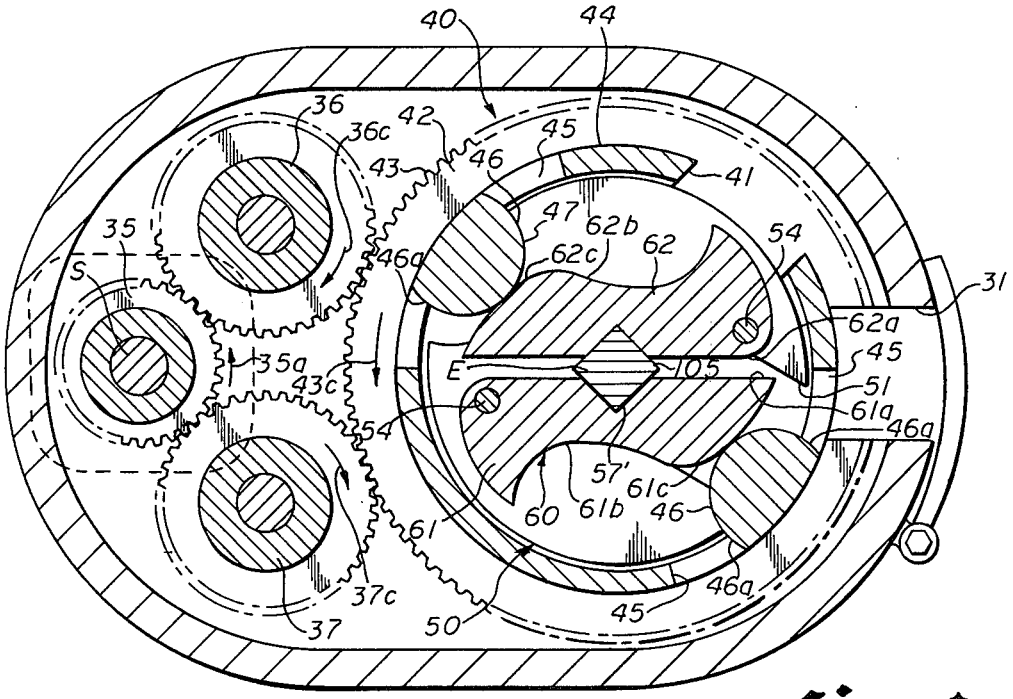
FIG. 4 is a view similar to FIG. 3 but illustrates the relationship of the cage support means, cage means and jaw means when the cage assembly has been turned over so that the tong apparatus functions to effect a threaded disconnection between the elongated members.

The pivoting arrangement of the jaw means 60 enables them to move as illustrated in FIGS. 3 and 4 of the drawings to engage the elongated member E, and to retract from engagement therefrom as illustrated in FIG. 2 of the drawing and as will be described in greater detail herein.

The jaw means 60 comprises a pair of opposed segments 61 and 62 of suitable size and width to be received in the cage assembly 50 and pivotally connected between the plate 52 and 53 by the pins 54 as shown in the drawings.

Figure 6:
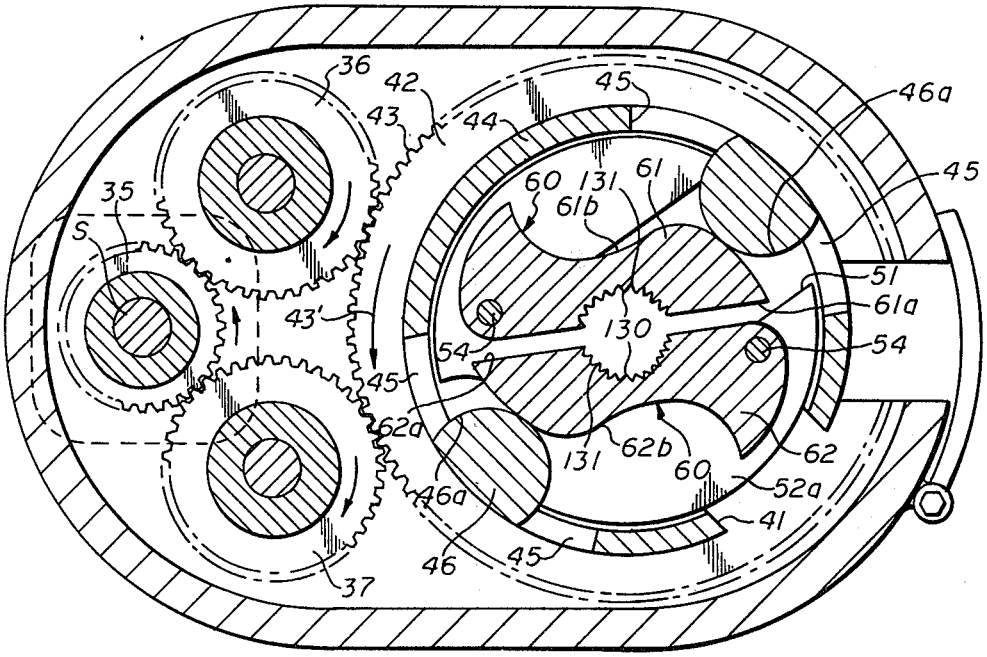
FIG. 6 is a view similar to FIG. 2 and illustrates an alternate form of gripping surface means on the jaw means for engaging an elongated member.

The jaw segments 61 and 62 are each shaped so as to have one edge in generally opposed relationship as shown in FIGS. 2, 4 and 6 of the drawings at 61*a* and 62*a*, respectively. Each edge 61*a*, 62*a* extends longitudinally of each segment 61, 62 as shown. The other edge 61*b* and 62*b* of each jaw 61, 62 is suitably contoured so that such edges 61*b* and 62*b*, along with the arcuate surfaces 46*a* on each of the cams 46 provide cooperating surface means to force the jaw segments 61 and 62 into operative position to grip the member E, when it is desired to rotate the member E relative to the member E′ to connect or disconnect therebetween.

The actuation of the jaw segments 61, 62 by the cooperating surfaces 61*b*, 62*b* and 46*a* on the jaw segments 61, 62 and cams 46 respectively, is effected by the restraining means referred to generally at 75 in FIGS. 1, 7, 8 and 9 of the drawings.

The restraining means 75 includes a housing referred to generally at 76 having an annular rim 77 and an upstanding wall 78 connected by the top 79. It will be noted that the top surface 79 is provided with a slot 80 which aligns with the slot 31 in the housing 30 to enable the member E to be positioned in such slot means. A brake band 81 is supported on the strip or band 84*a* which extends circumferentially of and adjacent the inner surface of annular wall 78 as more clearly illustrated in FIGS. 8 and 9 of the drawings. The band 84*a* supporting brake band 81 is secured at one end 82 between the spaced projections 83 on the wall 78 adjacent slot 80 by any suitable means such as a pin 84 or the like as shown in the FIG. 7 which extends through openings 83*a* in projections 83 and extends through loop 82*a* on one end of the band or strip 84*a*.

The other end of the brake band support 84*a* is bent, or shaped, to extend laterally and projects outwardly through the circumferential slot 85 in the wall 78 as shown, for connection with the threaded bolt 86, as will be described. A projection 87 on wall 78 spans the opening approximately midway thereof.

A spring 88 is then positioned on the bolt 86 so that one end thereof rests on head 90 of the bolt. The bolt is then inserted through an opening (not shown) in projection 87 and the other end of spring 88 abuts projection 87. A nut 86*a* (and washer if desired) is then threadedly engaged on the bolt 86 and the bolt end then inserted in an opening (not shown) in the end of the band 84*a* which projects through the slot 85. A member 86*b* with a threaded opening is secured on the end of the band 84*a* for threadedly engaging with the bolt 86 to secure the band 84*a* to bolt 86. The nut 86*a* is moved on the threaded portion of the bolt 86 to abut band 84*a* so that bolt 86 is locked thereto by nut 86*a* after the drag shoe 95 and the brake band 81 are assembled, the tension applied by brake band 81 on surface 95*a* of drag shoe 95 may be adjusted by backing nut 86*a* away from the band 84*a* and then rotating bolt 86 so that it threadedly engages the end of the band 84*a* in a manner to tighten or loosen the grip of the brake band 81 on the surface 95*a* as desired. The band 84*a* and brake shoe 81 is retained in any desired tension against surface 95*a* by rotating the lock nut 86*a* to abut band 84*a* so that bolt 86 is locked in engagement with the band 84*a*. The brake band 81 or shoe terminates in spaced relation to the ends of the band 84*a* as shown at 84 in the drawings.

Figure 8:
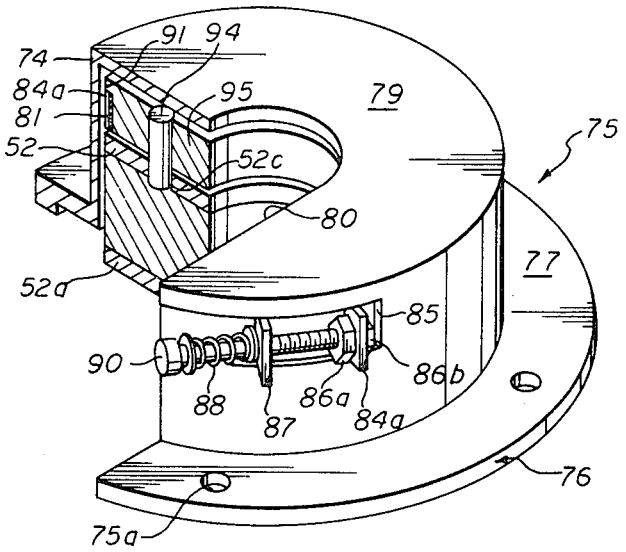
FIG. 8 is a partial sectional view of the drag shoe or restraining means housing illustrating in greater detail the relationship of the drag shoe to the brake band and cage means or cage assembly.

It will be noted that the drag means or drag shoe means 95 is provided with an annular lip 91 which overhangs the brake band 81 and its support 84*a* as shown as in FIGS. 7 and 8 of the drawings to assist in retaining the band 81, its support 84*a* and drag shoe means 95 connected together when the restraining means 75 is disconnected from the top 34 of the housing 30 of the tong apparatus 20 for access to the cage assembly 50 and the like. It will be noted that the annular ring portion 77 of the restraining means 75 is provided with suitable openings 75*a* which receive suitable means such as the threaded bolts 78*a* therethrough for positioning the restraining means 75 on the top 34 of the housing 30.

Figure 9:
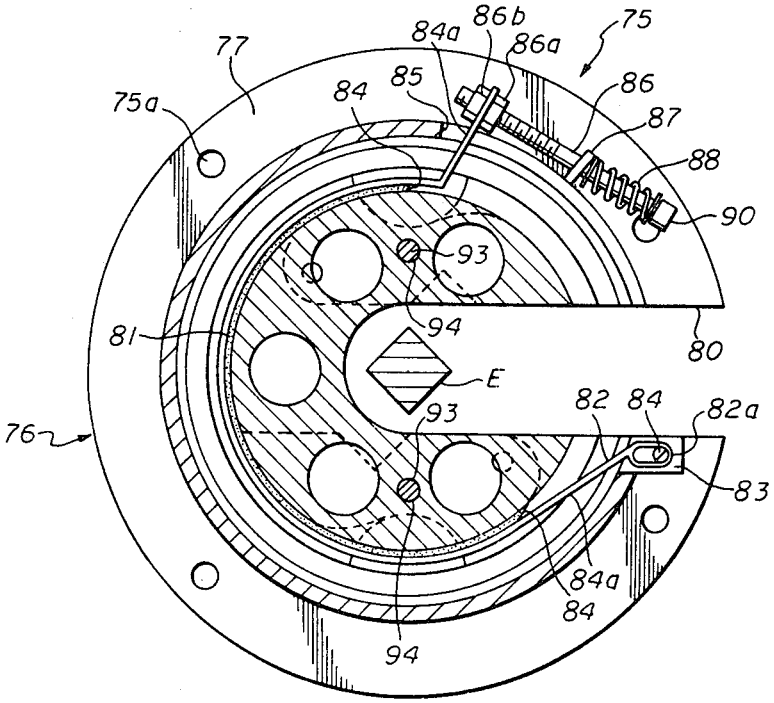
FIG. 9 is a sectional view on the line 9—9 of FIG. 1 and illustrates the details of arrangement of the brake band relative to the drag band or restraining means housing and its manner of support thereon, the drag shoe means, and the means of interconnecting the drag shoe means with the jaw means in the cage means.

Suitable means are provided to interconnect the restraining means 75 with the cage means 50 and hence the jaw means 60, such means being in the form of pins 93 which fit in openings 94 of the drag shoe 95 as shown in FIGS. 7–9 inclusive of the drawings. The pins 93 engage in openings 52*c* in the top plate 52 of the cage means 50 as shown in the drawings to act as a restraint to inhibit relative rotation between the cage means 50 and the cage support means 40 upon initial rotation of the cage support means or final drive gear means 42.

Backup means referred to at 100 are supported on the bottom of the housing 30 and are provided with slot means 101 for engaging the other elongated member E′ and restraining it or holding it while the member E is rotated relative thereto to threadedly connect or disconnect therewith.

It is to be also noted that a cover plate 35 is pivotally mounted by the hinge means 36 on housing 30 to close off the opening 31 after the members E and E′ are moved from the position shown in 42 to a position in slot 31 as illustrated in FIGS. 2 and 4.

The tong apparatus of the present invention may be employed to connect the members, commonly referred to as "sucker rods", together, or disconnect them. It also may be employed for connecting small diameter tubular members together and or disconnecting them.

Where the members E and E′ are sucker rods which are to be connected or disconnected by the tong apparatus 20 of the present invention, the end surface of the members E and E′ are provided with non-circular portions such as represented at 105 in FIG. 1 of the drawings to engage the non-circular portion 105 of one of the members. When sucker rods are to be connected together, the edges 61*a*, 62*a* will have gripping surface means 120 with a configuration as illustrated in FIGS. 2 and 4 of the drawings. Where the members E and E′ are small diameter tubular members to be threadedly connected or disconnected, the gripping surface means formed on each edge 61*a*, 62*a* of the segment 61, 62 respectively, which engages non-circular portion 105 will have the configuration represented at 130 in FIG. 6.

It will be noted that the configuration 120 in the edges 61*a*, 62*a* of the segments 61, 62 respectively, as shown in FIGS. 2 and 4, is a V-shaped notch, with the total angle between the sides 121 and 125 of each V-shaped notch in each edge 61*a*, 62*a* being about 90°. We have discovered that when the angle represented at 124 formed by a line extending through the apex 123 of each of the notches, and the edge 121 of each of of the notches is approximately 57°, the gripping surface means 120 may be employed to threadedly connect or disconnect sucker rods from within the size range of ½″ through 1⅛″ without requiring any adjustment or manipulation of the jaw means 60. It will be noted that the line through the apex 123 of each V-shaped notch in each jaw segment 61, 62 is represented at 122. While the angle represented at 124 between the line 122 through the apex of each notch and the side 121 of each V-shaped notch in each edge 61*a*, 62*a* is preferably 57° plus or minus 30′, it may be that under some circumstances the angle 124 may be 57° plus or minus 2°.

Where sucker rods are to be threadedly engaged, as represented by the letters E and E′ respectively, they are moved from the position represented in FIG. 2 of the drawings outside housing 30 to the position shown in FIG. 1 of the drawings, at which time the uppermost sucker rod E is positioned within the slot means 31, 41, 51 and 80′. The upper end of the lower sucker rod E′ is engaged with the lower end of the upper sucker rod E. The non-circular end 105 of the sucker rod E′ is held by slot 101 in backup member 100 as sucker rod is rotated. It then is desirable to actuate the power source P so that the motor M rotates the pinion 35 to in turn rotate the gears 36 and 37.

When the gears 36 and 37 are rotated in the direction represented by arrows 36*b*, 37*b* in FIG. 2, rotation is imparted to the final drive gear means, or the cage support means 42 in the clockwise direction represented by the arrow 43′ in FIG. 2. As rotation of the cage support means 42 is initiated, the tension in brake band 81 acting on the annular surface 95*a* of drag shoe 95 restrains rotation of the cage assembly 50 and jaw means 60 carrier thereby. Such restraining action is caused by reason of the pins 93 which interconnect the cage means 50 with the drag shoe 95 as previously described. By reason of this restraining action, the arcuate surfaces 46*a* of each cam 46 move from the position shown in FIG. 2 of the drawings, along edges 61*b*, 62*b* of each jaw segment to engage the outwardly flared portion 61*c*, 62*c* formed on each edge 61*b*, 62*b* of the segments 61 and 62. Engagement of the cam surfaces 46*a* with the portions 61*c*, 62*c* of the edges 61*b*, 62*b*, causes the jaw segments 61, 62 and the cage assembly 50 to move into gripping engagement with the non-circular portion 105 of one of the members E as represented in FIG. 3 of the drawings.

When this occurs, continued rotation of the cage support means by the power source P and motor M through the gears 35, 36 and 37 in the direction represented by the arrow 43′ in FIG. 3 will cause the cage support means 42, cage assembly 50 and jaw means 60 to move as a unit and rotate the member E. It can be appreciated that the non-circular portion 105 of the member E′ is retained by the backup means 100 carried by housing 30, and, as previously noted, is initially positioned in engagement with the lower threaded pin end of the member E so that rotation of the member E will effect threaded connection between the pin end sucker rod represented in E and the box end of the sucker rod represented at E′. When the sucker rods represented at E and E′ have been threadedly engaged, the power source P is actuated so as to reverse the hydraulic motor M, and thereby reverse the rotation of cage support means 42. This acts to disengage the jaw segments 61, 62 from the non-circular portion 105 of each of the sucker rods E and E′ and reposition the jaw segments 61, 62 as shown in FIG. 2 of the drawings to enable the connected sucker rods E and E′ to be moved longitudinally through the tong apparatus 20 and into the well bore until the upper box end of the sucker rod E assumes a position immediately adjacent the bottom 34*a* of the housing 30 so that the non-circular portion thereon may be engaged in slot 101 of backup member 100. Another sucker rod may be lifted by means well in the art and positioned vertically through slot 81 and through the tong 20 to abut the upper end of the sucker rod E′ adjacent the bottom 34*a* of the housing 30. It will also be appreciated that the lower end of the member E is engaged in the upper end of the member E′ so that when the member E is rotated, threaded connection between E and E′ is effected as described hereinabove.

If it is desired to disconnect sucker rods as represented by E and E′, as they are withdrawn from an oil or gas well, the tong apparatus 20 of the present invention is again positioned as illustrated in FIG. 1 of the drawings.

However, prior to positioning such tong apparatus 20, the restraining means 75 will be removed from the housing 30 so as to expose the cage 50 in the receptacle 47. The cage means 50 is manually lifted therefrom and is turned completely over and then set back in the receptacle 47. The restraining means 75 is then repositioned on the top 34 of the housing and retained therein by the bolts 78*a* as previously described.

After the cage assembly 50 with the jaw means 60 therein have been flipped over 180° and repositioned in the receptacle 47, they will assume the position shown in FIG. 4 of the drawings. After the connected sucker rods E and E′ have been positioned in the tong apparatus as generally represented in FIG. 1 of the drawings, rotation is imparted by motor M to the gear means 35 in the direction represented by the arrow 35*a* in FIG. 4 of the drawings. This in turn imparts rotation to the gears 36 and 37 in the direction represented at 36*c* and 37*c* respectively in FIG. 4 of the drawings, which reverses the direction of rotation of the final drive gear 42 as represented by the arrow 43*c* in FIG. 4. The rotation of the cage support means 42 in the direction 43*c* causes the cams 46 and surfaces 61*b*, 62*b* to cooperate and move the segments 61, 62 into gripping and rotating engagement with the non-circular portion 105 of one of the sucker rods, which will be the uppermost sucker rod as represented in FIG. 1 of the drawings. After the jaw segment have engaged the non-circular portion 105 as illustrated in FIG. 4 of the drawings, continued rotation of the cage support means 42 in the direction represented by the arrow 43*c* will rotate the upper sucker rod in a direction so as to threadedly disconnect it from the sucker rod E′. Thereafter, the sucker rod E may be either manually moved or moved by a suitable means up out of the tong apparatus of the present invention. The sucker rod E′ is then moved upwardly through the tong apparatus 20 of the present invention by means well known in the art so that it then assumes a position in the tong apparatus 20 represented by the letter E with which a sucker rod E′ is connected at the lower end thereof. The operation described hereabove is then repeated until the complete string of sucker rods has been step-wise lifted into the tong apparatus of the present invention to enable them to be step-wise disconnected as they are lifted from the well bore.

Where small diameter tubular members are to be either threadedly engaged or threadedly disengaged, the gripping surface means 130 on each edge 61*a*, 62*a* of each jaw segment, 61, 62 is employed. The surface means 130 is generally semi-circular in shape and is provided with longitudinally extending serrations therein as shown in FIG. 6 of the drawings. To connect small diameter tubular members by the tong apparatus of the present invention, the motor means M is rotated in a direction so as to impart rotation to the final drive gear 42 in the direction represented by the arrow 43′ of FIG. 2 of the drawings. Otherwise, the operation for connecting the tubular members is that as described with regard to the sucker rod connection given hereinabove.

If it is desired to disconnect small diameter tubular members, the jaw segments as shown in FIG. 6 are flipped over 180 degrees as previously described. In other words, the restraining means 75, and more particularly the housing 76, is removed from the upper surface 34 of the housing 30 for gaining access to the receptacle 47 in which the cage assembly 50 is carried. The cage assembly 50 is then lifted out of the receptacle and turned over to reverse the position of the jaw segments as illustrated in FIG. 4. Thereupon, the final drive gear 42 is rotated in the opposite direction represented by the arrow 43*c* in FIG. 4 to accomplish threaded disconnection between the small diameter tubular members.

The cage assembly 50 is positioned in the receptacle formed by annular wall 44 and bottom 47 by aligning slot 51 and recess 51*a* of the cage assembly 50 with the cams 46. The assemble is then lowered onto bottom 47 and rotated within the receptacle to its proper position. Removal is effected by reversing the foregoing procedure.

Particular attention is directed to the arrangement of the restraining means 75 in relation to the other components of the tong apparatus 20 in that such restraining means 75 is positioned above the jaw segments 61, 62 which greatly reduces, if not substantially eliminates fouling of such restraining means 75 by oil or other debris normally associated with the members E and E′. The tong apparatus of the prior art with which applicants are familiar has been positioned relative to the cams that engage the members E and E′ so as to collect debris or to become more readily fouled than the arrangement of the present invention.

Also, it will be noted that by reason of the relationship of the lip 91 to the annular surface 95*a* of the drag shoe 95, the brake band 81 and the drag shoe 95 remain engaged within the housing 76 of the restraining means 75 when the housing 76 is removed from the tong housing 30 to gain access to the cage assembly 50 in the receptacle 47 for turning such cage assembly over when it is desired to disconnect either sucker rods or tubular members. This has proved substantially advantageous in that by retaining the relative position of the brake band and the drag shoe, it is not necessary to reassemble the components of the restraining means each time it is removed from the housing 30 for access to the cage assembly 50 to turn it over.

Also, by reason of the angular relationship of the V-shaped notch in each edge 61*a*, 62*a*, sucker rods within the size range of $\frac{1}{2}''$ to about $1\frac{1}{8}''$ may be accommodated by the present invention to either threadedly connect them together, or to threadedly disconnect the sucker rods from each other by the tong apparatus of the present invention without replacing the cage assembly for each size, or adjusting the jaw means in the cage assembly, which is normally required with tong apparatus presently in use and known to applicants.

The foregoing disclosure and description of the invention are illustrative and explanatory thereof, and various changes in the size, shape, and materials as well as in the details of the illustrated construction may be made without departing from the spirit of the invention.

What is claimed is:

1. In a tong apparatus for threadedly connecting and disconnecting a pair of members wherein cage support means are rotatably carried by a tong housing with jaw means which are pivotally mounted in cage means carried by the cage support means to grip one of the pair of members and rotate it upon rotation of the cage support means and backup means carried by the tong housing to hold the other of the pair of members so that connection and disconnection of the pair of members may be effected, the invention comprising restraining means mounted on the tong housing above the cage means to restrain relative rotation between the cage means and the cage support means upon initial rotation of the cage support means including:

a. drag band housing means secured on the tong housing above said cage means;

b. brake band means extending circumferentially of said drag band housing means, said brake band means being secured at one end to said drag band housing means and adjustably supported at its other end on said drag band housing means;

c. drag shoe means supported by and frictionally engaged with said brake band means;

d. an annular lip on said drag shoe means overhanging said brake band means to retain said brake band, drag shoe and drag band housing means connected together when the restraining means is removed from the tong housing; and e. means interconnecting said drag shoe means and the cage means.

* * * * *